US008857155B2

(12) United States Patent
Surnilla et al.

(10) Patent No.: US 8,857,155 B2
(45) Date of Patent: Oct. 14, 2014

(54) METHODS AND SYSTEMS FOR HUMIDITY DETECTION VIA AN EXHAUST GAS SENSOR

(71) Applicant: Ford Global Technologies, LLC, Dearborn, MI (US)

(72) Inventors: Gopichandra Surnilla, West Bloomfield, MI (US); Richard E. Soltis, Saline, MI (US); Timothy Schram, Troy, MI (US); Timothy Joseph Clark, Livonia, MI (US); Evangelos Skoures, Detroit, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 20 days.

(21) Appl. No.: 13/745,639

(22) Filed: Jan. 18, 2013

(65) Prior Publication Data

US 2014/0202135 A1 Jul. 24, 2014

(51) Int. Cl.

| | |
|---|---|
| ***F01N 3/00*** | (2006.01) |
| ***F02M 25/06*** | (2006.01) |
| ***G01M 15/00*** | (2006.01) |
| ***F01N 11/00*** | (2006.01) |

(52) U.S. Cl.
CPC ..... *F01N 11/007* (2013.01)
USPC ..... 60/276; 60/274; 60/278; 60/285; 73/114.73

(58) Field of Classification Search
USPC ..... 60/274, 276, 278, 285; 73/114.72, 73/114.73
See application file for complete search history.

(56) References Cited

U.S. PATENT DOCUMENTS

| | | | | |
|---|---|---|---|---|
| 5,348,630 | A | 9/1994 | Yagi et al. | |
| 2010/0236532 | A1 | 9/2010 | Xiao et al. | |
| 2011/0132340 | A1 | 6/2011 | Soltis | |
| 2011/0132342 | A1 * | 6/2011 | Soltis et al. | 123/703 |

* cited by examiner

*Primary Examiner* — Audrey K Bradley
(74) *Attorney, Agent, or Firm* — Julia Voutyras; Alleman Hall McCoy Russell & Tuttle LLP

(57) ABSTRACT

Various methods and system are described for determining ambient humidity via an exhaust gas sensor disposed in an exhaust system of an engine. In one example, a reference voltage of the sensor is modulated between a first and second voltage during non-fueling conditions of the engine. The ambient humidity is determined based on an average change in pumping current while the voltage is modulated.

19 Claims, 5 Drawing Sheets

METHODS AND SYSTEMS FOR HUMIDITY DETECTION VIA AN EXHAUST GAS SENSOR

TECHNICAL FIELD

The present application relates generally to ambient humidity detection via an exhaust gas sensor coupled in an exhaust system of an internal combustion engine.

BACKGROUND AND SUMMARY

During engine non-fueling conditions in which at least one intake valve and one exhaust valve are operating, such as deceleration fuel shut off (DFSO), ambient air may flow through engine cylinders and into the exhaust system. In some examples, an exhaust gas sensor may be utilized to determine ambient humidity during the engine non-fueling conditions. It may take a long time for the exhaust flow to be devoid of hydrocarbons during the engine non-fueling conditions, however, and, as such, an accurate indication of ambient humidity may be delayed.

The inventors herein have recognized the above issue and have devised an approach to at least partially address it. Thus, a method for an engine system which includes an exhaust gas sensor is disclosed. In one example, the method includes, during engine non-fueling conditions, where at least one intake valve and one exhaust valve are operating: modulating a reference voltage of the sensor; generating an ambient humidity based on a corresponding change in pumping current of the sensor; and, during selected operating conditions, adjusting an engine operating parameter based on the ambient humidity.

By modulating the reference voltage and determining the change in pumping current while the air fuel ratio is still changing during non-fueling conditions, such as DFSO, the effect of the changing air fuel ratio may be nullified. As such, the ambient humidity may be determined in a shorter amount of time, as the exhaust air fuel ratio does not have to be stable before an accurate indication of ambient humidity may be determined.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to methods and systems for an engine system with an exhaust gas sensor. In one example, a method comprises, during engine non-fueling conditions, where at least one intake valve and one exhaust valve are operating: modulating a reference voltage of the sensor, generating an ambient humidity based on a corresponding change in pumping current of the sensor, and adjusting an engine operating parameter based on the ambient humidity. As an example, the change in pumping current may be averaged over a duration during the non-fueling conditions. In this way, accuracy of the humidity determination based on the change in pumping current may be improved, for example. Further, the ambient humidity determination may be made in a reduced amount of time, as averaging the change in pumping current reduces the effect of a changing air fuel ratio. Once the ambient humidity is determined, one or more engine operating parameters may be adjusted during fueling conditions, for example. In one example, an amount of exhaust gas recirculation (EGR) is adjusted based on the ambient humidity. In this way, the system can nullify the effect of the changing air fuel ratio by modulating the reference voltage.

Figure 1:
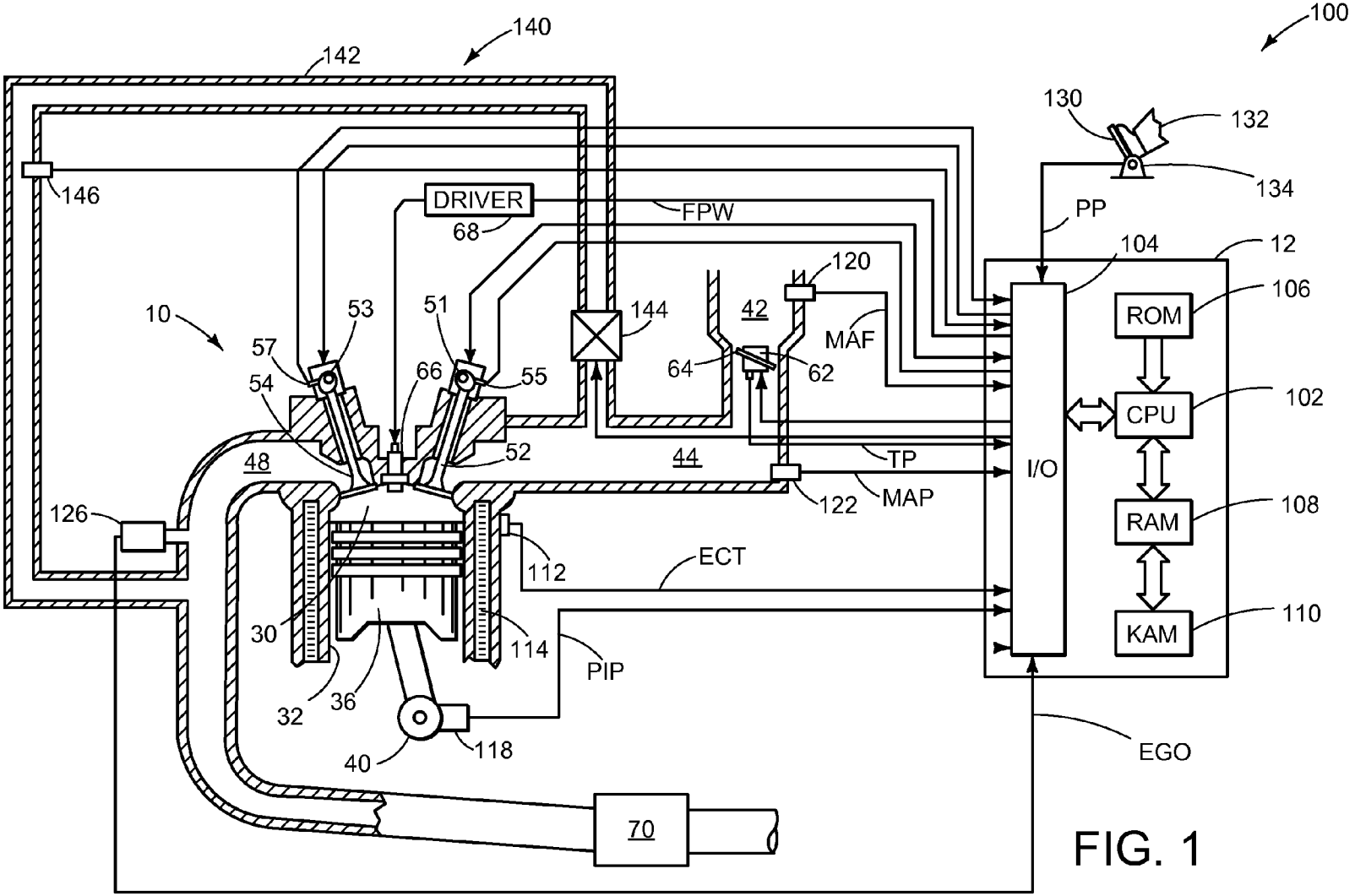
FIG. 1 shows an example embodiment of a combustion chamber in an engine system including an exhaust system and an exhaust gas recirculation system.

FIG. 1 is a schematic diagram showing one cylinder of a multi-cylinder engine 10 in an engine system 100, which may be included in a propulsion system of an automobile. The engine 10 may be controlled at least partially by a control system including a controller 12 and by input from a vehicle operator 132 via an input device 130. In this example, the input device 130 includes an accelerator pedal and a pedal position sensor 134 for generating a proportional pedal position signal PP. A combustion chamber (i.e., cylinder) 30 of the engine 10 may include combustion chamber walls 32 with a piston 36 positioned therein. The piston 36 may be coupled to a crankshaft 40 so that reciprocating motion of the piston is translated into rotational motion of the crankshaft. The crankshaft 40 may be coupled to at least one drive wheel of a vehicle via an intermediate transmission system. Further, a starter motor may be coupled to the crankshaft 40 via a flywheel to enable a starting operation of the engine 10.

The combustion chamber 30 may receive intake air from an intake manifold 44 via an intake passage 42 and may exhaust combustion gases via an exhaust passage 48. The intake manifold 44 and the exhaust passage 48 can selectively communicate with the combustion chamber 30 via respective intake valve 52 and exhaust valve 54. In some embodiments, the combustion chamber 30 may include two or more intake valves and/or two or more exhaust valves.

In this example, the intake valve 52 and exhaust valve 54 may be controlled by cam actuation via respective cam actuation systems 51 and 53. The cam actuation systems 51 and 53 may each include one or more cams and may utilize one or more of cam profile switching (CPS), variable cam timing (VCT), variable valve timing (VVT), and/or variable valve lift (VVL) systems that may be operated by the controller 12 to vary valve operation. The position of the intake valve 52 and exhaust valve 54 may be determined by position sensors 55 and 57, respectively. In alternative embodiments, the intake valve 52 and/or exhaust valve 54 may be controlled by electric valve actuation. For example, the cylinder 30 may alternatively include an intake valve controlled via electric valve actuation and an exhaust valve controlled via cam actuation including CPS and/or VCT systems.

A fuel injector 66 is shown coupled directly to combustion chamber 30 for injecting fuel directly therein in proportion to the pulse width of signal FPW received from the controller 12 via an electronic driver 68. In this manner, the fuel injector 66 provides what is known as direct injection of fuel into the combustion chamber 30. The fuel injector may be mounted in the side of the combustion chamber or in the top of the combustion chamber (as shown), for example. Fuel may be delivered to the fuel injector 66 by a fuel system (not shown) including a fuel tank, a fuel pump, and a fuel rail. In some embodiments, the combustion chamber 30 may alternatively or additionally include a fuel injector arranged in the intake manifold 44 in a configuration that provides what is known as port injection of fuel into the intake port upstream of the combustion chamber 30.

The intake passage 42 may include a throttle 62 having a throttle plate 64. In this particular example, the position of throttle plate 64 may be varied by the controller 12 via a signal provided to an electric motor or actuator included with the throttle 62, a configuration that is commonly referred to as electronic throttle control (ETC). In this manner, the throttle 62 may be operated to vary the intake air provided to the combustion chamber 30 among other engine cylinders. The position of the throttle plate 64 may be provided to the controller 12 by a throttle position signal TP. The intake passage 42 may include a mass air flow sensor 120 and a manifold air pressure sensor 122 for providing respective signals MAF and MAP to the controller 12.

An exhaust gas sensor 126 is shown coupled to the exhaust passage 48 upstream of an emission control device 70. The sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_x$, HC, or CO sensor. The emission control device 70 is shown arranged along the exhaust passage 48 downstream of the exhaust gas sensor 126. The device 70 may be a three way catalyst (TWC), $NO_x$ trap, various other emission control devices, or combinations thereof. In some embodiments, during operation of the engine 10, the emission control device 70 may be periodically reset by operating at least one cylinder of the engine within a particular air/fuel ratio.

Further, in the disclosed embodiments, an exhaust gas recirculation (EGR) system 140 may route a desired portion of exhaust gas from the exhaust passage 48 to the intake manifold 44 via an EGR passage 142. The amount of EGR provided to the intake manifold 44 may be varied by the controller 12 via an EGR valve 144. Further, an EGR sensor 146 may be arranged within the EGR passage 142 and may provide an indication of one or more of pressure, temperature, and constituent concentration of the exhaust gas. Under some conditions, the EGR system 140 may be used to regulate the temperature of the air and fuel mixture within the combustion chamber, thus providing a method of controlling the timing of ignition during some combustion modes. Further, during some conditions, a portion of combustion gases may be retained or trapped in the combustion chamber by controlling exhaust valve timing, such as by controlling a variable valve timing mechanism.

The controller 12 is shown in FIG. 1 as a microcomputer, including a microprocessor unit 102, input/output ports 104, an electronic storage medium for executable programs and calibration values shown as read only memory chip 106 in this particular example, random access memory 108, keep alive memory 110, and a data bus. The controller 12 may receive various signals from sensors coupled to the engine 10, in addition to those signals previously discussed, including measurement of inducted mass air flow (MAF) from the mass air flow sensor 120; engine coolant temperature (ECT) from a temperature sensor 112 coupled to a cooling sleeve 114; a profile ignition pickup signal (PIP) from a Hall effect sensor 118 (or other type) coupled to crankshaft 40; throttle position (TP) from a throttle position sensor; and absolute manifold pressure signal, MAP, from the sensor 122. Engine speed signal, RPM, may be generated by the controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, the sensor 118, which is also used as an engine speed sensor, may produce a predetermined number of equally spaced pulses every revolution of the crankshaft.

The storage medium read-only memory 106 can be programmed with computer readable data representing non-transitory instructions executable by the processor 102 for performing the methods described below as well as other variants that are anticipated but not specifically listed.

As described above, FIG. 1 shows only one cylinder of a multi-cylinder engine, and each cylinder may similarly include its own set of intake/exhaust valves, fuel injector, spark plug, etc.

Figure 2:
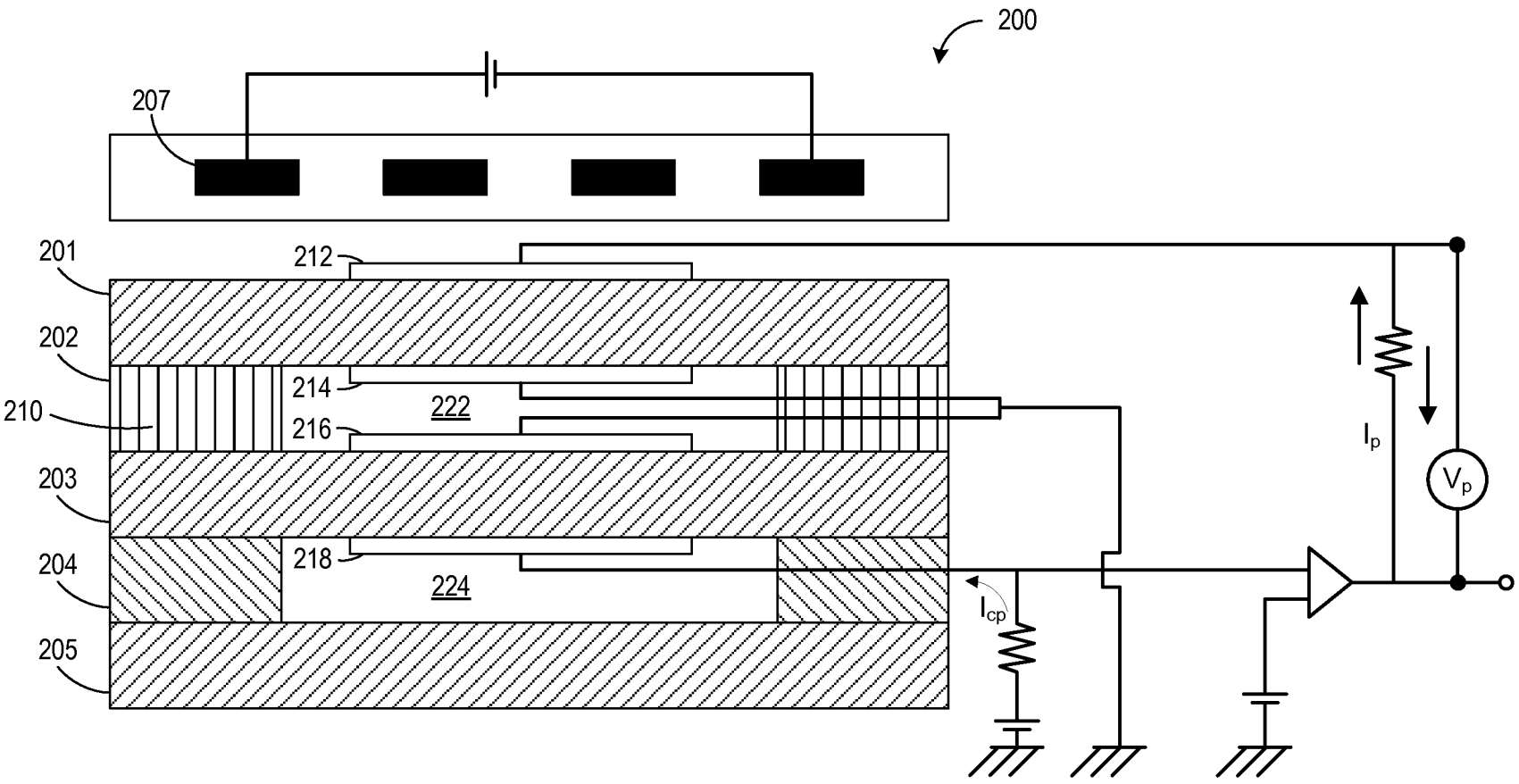
FIG. 2 shows a schematic diagram of an example exhaust gas sensor.

FIG. 2 shows a schematic view of an example embodiment of an exhaust gas sensor, such as a UEGO sensor 200 configured to measure a concentration of oxygen ($O_2$) in an exhaust gas stream. The sensor 200 may operate as the exhaust gas sensor 126 described above with reference to FIG. 1, for example. The sensor 200 comprises a plurality of layers of one or more ceramic materials arranged in a stacked configuration. In the embodiment of FIG. 2, five ceramic layers are depicted as layers 201, 202, 203, 204, and 205. These layers include one or more layers of a solid electrolyte capable of conducting ionic oxygen. Examples of suitable solid electrolytes include, but are not limited to, zirconium oxide-based materials. Further, in some embodiments such as that shown in FIG. 2, a heater 207 may be disposed in thermal communication with the layers to increase the ionic conductivity of the layers. While the depicted UEGO sensor 200 is formed from five ceramic layers, it will be appreciated that the UEGO sensor may include other suitable numbers of ceramic layers.

The layer 202 includes a material or materials creating a diffusion path 210. The diffusion path 210 is configured to introduce exhaust gases into a first internal cavity 222 via diffusion. The diffusion path 210 may be configured to allow one or more components of exhaust gases, including but not limited to a desired analyte (e.g., $O_2$), to diffuse into the internal cavity 222 at a more limiting rate than the analyte can be pumped in or out by pumping electrodes pair 212 and 214. In this manner, a stoichiometric level of $O_2$ may be obtained in the first internal cavity 222.

The sensor 200 further includes a second internal cavity 224 within the layer 204 separated from the first internal cavity 222 by the layer 203. The second internal cavity 224 is configured to maintain a constant oxygen partial pressure equivalent to a stoichiometric condition, e.g., an oxygen level present in the second internal cavity 224 is equal to that which the exhaust gas would have if the air-fuel ratio was stoichiometric. The oxygen concentration in the second internal cavity 224 is held constant by pumping current $I_{cp}$. Herein, the second internal cavity 224 may be referred to as a reference cell.

A pair of sensing electrodes 216 and 218 is disposed in communication with first internal cavity 222 and the reference cell 224. The sensing electrodes pair 216 and 218 detects a concentration gradient that may develop between the first internal cavity 222 and the reference cell 224 due to an oxygen concentration in the exhaust gas that is higher than or lower than the stoichiometric level. A high oxygen concentration may be caused by a lean exhaust gas mixture, while a low oxygen concentration may be caused by a rich mixture, for example.

The pair of pumping electrodes 212 and 214 is disposed in communication with the internal cavity 222, and is configured to electrochemically pump a selected gas constituent (e.g., $O_2$) from the internal cavity 222 through the layer 201 and out of the sensor 200. Alternatively, the pair of pumping electrodes 212 and 214 may be configured to electrochemically pump a selected gas through the layer 201 and into the internal cavity 222. Herein, the pumping electrodes pair 212 and 214 may be referred to as an $O_2$ pumping cell.

The electrodes 212, 214, 216, and 218 may be made of various suitable materials. In some embodiments, the electrodes 212, 214, 216, and 218 may be at least partially made of a material that catalyzes the dissociation of molecular oxygen. Examples of such materials include, but are not limited to, electrodes containing platinum and/or gold.

The process of electrochemically pumping the oxygen out of or into the internal cavity 222 includes applying an electric current $I_p$ across the pumping electrodes pair 212 and 214. The pumping current $I_p$ applied to the $O_2$ pumping cell pumps oxygen into or out of the first internal cavity 222 in order to maintain a stoichiometric level of oxygen in the cavity pumping cell. The pumping current $I_p$ is proportional to the concentration of oxygen in the exhaust gas. Thus, a lean mixture will cause oxygen to be pumped out of the internal cavity 222 and a rich mixture will cause oxygen to be pumped into the internal cavity 222.

A control system (not shown in FIG. 2) generates the pumping voltage signal $V_p$ as a function of the intensity of the pumping current $I_p$ required to maintain a stoichiometric level within the first internal cavity 222.

It should be appreciated that the UEGO sensor described herein is merely an example embodiment of a UEGO sensor, and that other embodiments of UEGO sensors may have additional and/or alternative features and/or designs.

Figure 3:
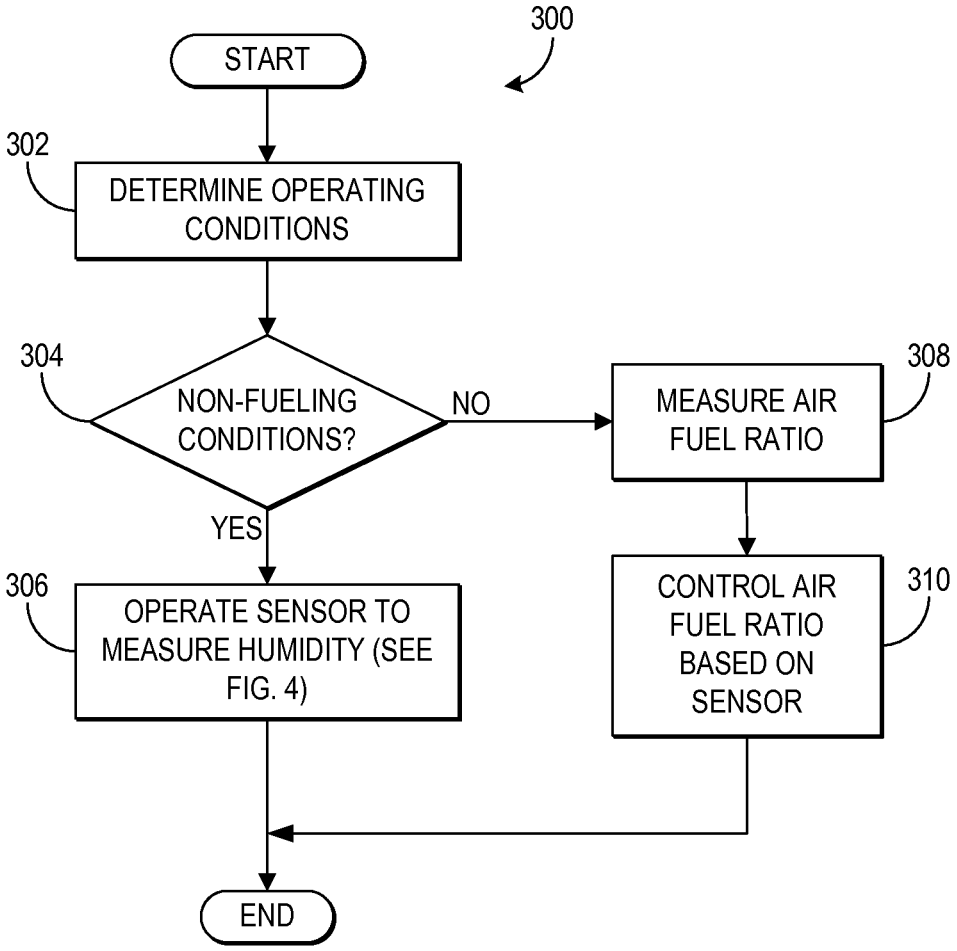
FIG. 3 is a flow chart illustrating a routine for determining a measurement mode of an exhaust gas sensor.
Figure 4:
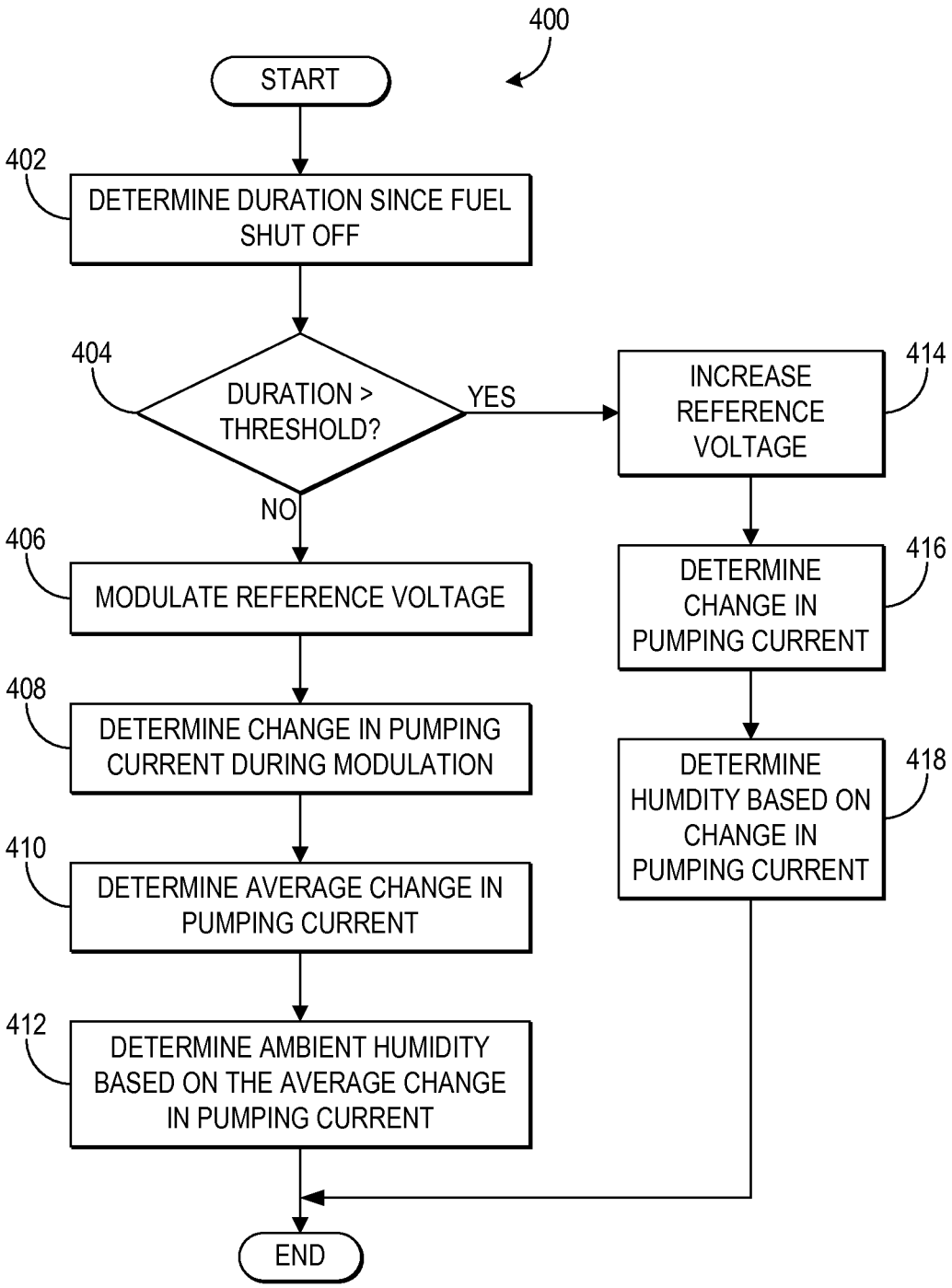
FIG. 4 is a flow chart illustrating a routine for determining ambient humidity based on an exhaust gas sensor.
Figure 6:
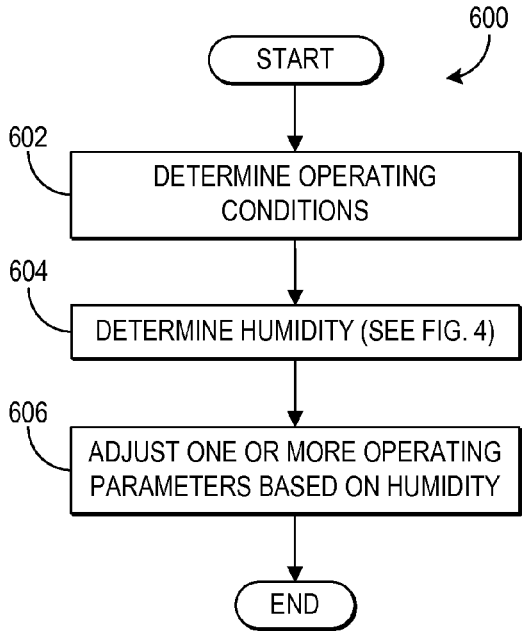
FIG. 6 is a flow chart illustrating a routine for adjusting engine operating parameters based on an ambient humidity generated by an exhaust gas sensor.

FIGS. 3, 4, and 6 show flow charts illustrating routines for an exhaust gas sensor and an engine system, respectively. For example, the routine shown in FIG. 3 determines whether the sensor should be operated to measure exhaust gas oxygen concentration or ambient humidity based on fueling conditions of the engine. The routine shown in FIG. 4 determines the ambient humidity based on an exhaust gas sensor, such as the exhaust gas sensor 200 described above with reference to FIG. 2. FIG. 6 shows a routine for adjusting an engine operating parameter based on the ambient humidity determined via the routine shown in FIG. 3.

FIG. 3 shows a flow chart illustrating a routine 300 for controlling an exhaust gas sensor, such as the exhaust gas sensor described above with reference to FIG. 2 and positioned as shown in FIG. 1, based on engine fueling conditions. Specifically, the routine determines if the engine system is operating under non-fueling conditions and adjusts a measurement mode of the sensor accordingly. For example, during non-fueling conditions, the sensor is operated in a mode to determine ambient humidity and during fueling conditions, the sensor is operated in a mode to measure exhaust gas oxygen concentration to determine air fuel ratio.

At 302 of routine 300 in FIG. 3, engine operating conditions are determined. As non-limiting examples, the engine operating conditions may include actual/desired amount of EGR, spark timing, air-fuel ratio, etc.

Once the operating conditions are determined, it is determined if the engine is under non-fueling conditions at 304 of routine 300. Non-fueling conditions include engine operating conditions in which the fuel supply is interrupted but the engine continues spinning and at least one intake valve and one exhaust valve are operating; thus, air is flowing through one or more of the cylinders, but fuel is not injected in the cylinders. Under non-fueling conditions, combustion is not carried out and ambient air may move through the cylinder from the intake passage to the exhaust passage. In this way, a sensor, such as an exhaust gas oxygen sensor, may receive ambient air on which measurements, such as ambient humidity detection, may be performed.

Non-fueling conditions may include, for example, deceleration fuel shut off (DFSO). DFSO is responsive to the operator pedal (e.g., in response to a driver tip-out and where the vehicle accelerates greater than a threshold amount). DSFO conditions may occur repeatedly during a drive cycle, and, thus, numerous indications of the ambient humidity may be generated throughout the drive cycle, such as during each DFSO event. As such, the overall efficiency of the engine may be maintained during driving cycles in which the ambient humidity fluctuates. The ambient humidity may fluctuate due to a change in altitude or temperature or when the vehicle enters/exits fog or rain, for example.

If it is determined that the engine is not operating under non-fueling conditions, for example, fuel is injected in one or more cylinders of the engine, routine 300 moves to 308. At 308, the exhaust gas sensor is operated as an air-fuel ratio sensor. In this mode of operation, the sensor may be operated as a lambda sensor, for example. As a lambda sensor, the output voltage may determine whether the exhaust gas air-fuel ratio is lean or rich. Alternatively, the sensor may operate as a universal exhaust gas oxygen sensor (UEGO) and an air-fuel ratio (e.g., a degree of deviation from a stoichiometric ratio) may be obtained from the pumping current of the pumping cell of the sensor.

At 310 of routine 300, the air-fuel ratio (AFR) is controlled responsive to the exhaust gas oxygen sensor. Thus, a desired exhaust gas AFR may be maintained based on feedback from the sensor during engine fueling conditions. For example, if a desired air-fuel ratio is the stoichiometric ratio and the sensor determines the exhaust gas is lean (i.e., the exhaust gas comprises excess oxygen and the AFR is less than stoichiometric), additional fuel may be injected during subsequent engine fueling operation.

On the other hand, if it is determined that the engine is under non-fueling conditions, the routine proceeds to 306, and the sensor is operated to determine ambient humidity. The ambient humidity may be determined based on the sensor output, as described in greater detail below with reference to FIG. 4. For example, a reference voltage of the sensor may be modulated between a minimum voltage at which oxygen is detected and a voltage at which water molecules may be dissociated such that the ambient humidity may be determined. It should be understood, the ambient humidity as determined (described below with reference to FIG. 4) is the absolute ambient humidity. Additionally, relative humidity may be obtained by further employing a temperature detecting device, such as a temperature sensor.

FIG. 4 shows a flow chart illustrating a routine 400 for determining ambient humidity via an exhaust gas sensor, such as the oxygen sensor described above with reference to FIG. 2, and positioned as shown in FIG. 1, for example. Specifically, the routine determines a duration since fuel shut off and determines an ambient humidity via the exhaust gas sensor in a manner based on the duration since fuel shut off. For example, when the duration since fuel shut off is less than a threshold duration, a reference voltage of the sensor is modulated between a first voltage and a second voltage in order to determine the ambient humidity. When the duration since fuel shut off is greater than the threshold duration, the reference voltage is not modulated.

At 402, the duration since fuel shut off is determined. In some examples, the duration since fuel shut off may be a time since fuel shut off. In other examples, the duration since fuel shut off may be a number of engine cycles since fuel shut off, for example. At 404, it is determined if the duration since fuel shut off is greater than a threshold duration. The threshold duration may be an amount of time until the exhaust is substantially free of hydrocarbons from combustion in the engine. For example, residual gases from one or more previous combustion cycles may remain in the exhaust for several cycles after fuel is shut off and the gas that is exhausted from the chamber may contain more than ambient air for a duration after fuel injection is stopped. Further, the period in which fuel is shut off may vary. For example, a vehicle operator may release the accelerator pedal and coast to a stop, resulting in a long DFSO period. In some situations, the fuel shut off period (the time from interruption of the fuel supply to restart of the fuel supply, for example) may not be long enough for the ambient air to establish an equilibrium state in the exhaust system. For example, a vehicle operator may tip-in shortly after releasing the accelerator pedal, causing DFSO to stop soon after beginning. In such a situation, routine 400 proceeds to 406.

If it is determined that the duration is less than the threshold duration, the routine continues to 406 and the sensor is operated in a first mode in which the reference voltage is modulated between a first voltage and a second voltage. As one non-limiting example, the first voltage may be 450 mV and the second voltage may be 950 mV. At 450 mV, for example, the pumping current may be indicative of an amount of oxygen in the exhaust gas. At 950 mV, water molecules may be dissociated such that the pumping current is indicative of the amount of oxygen in the exhaust gas plus an amount of oxygen from dissociated water molecules. The first voltage may be a voltage at which a concentration of oxygen in the exhaust gas may be determined, for example, while the second voltage may be a voltage at which water molecules may be dissociated. In this way, a humidity of the exhaust gas may be determined based on the water concentration.

In another example, the first voltage is 450 mV and the second voltage is 1080 mV. At 1080 mV, carbon dioxide ($CO_2$) molecules may be dissociated in addition to water molecules. In such an example, an amount of alcohol (e.g, ethanol) in the fuel may be determined based on the average change in pumping current while the voltage is modulated.

Figure 5:
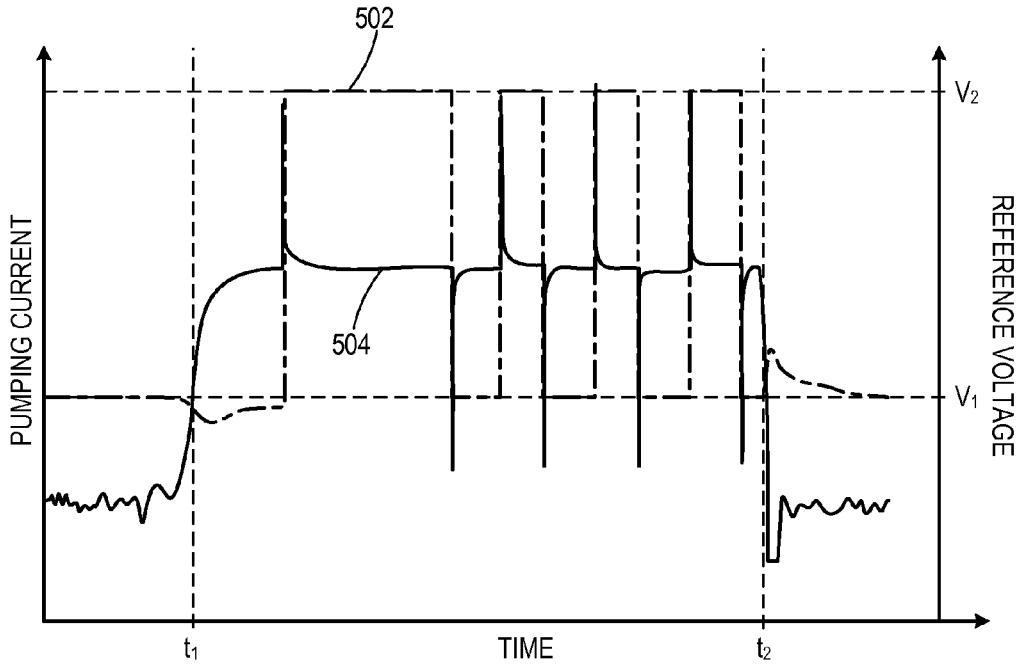
FIG. 5 shows a graph illustrating reference voltage and pumping current of an exhaust gas sensor during deceleration fuel cut off.

Continuing with FIG. 4, at 408, a change in pumping current during the modulation is determined. For example, the difference in pumping current at the first reference voltage and the pumping current at the second reference voltage is determined. FIG. 5 shows a graph illustrating an example of a modulated reference voltage 502 and corresponding change in pumping current 504 during a non-fueling condition such as DFSO. In the example depicted in FIG. 5, DFSO begins at a time $t_1$ and ends at a time $t_2$. As shown, the reference voltage 502 is modulated between a first voltage $V_1$ and a second voltage $V_2$, which is higher than the first voltage $V_1$. Responsive to the changing reference voltage 502, the pumping current 504 also changes. Thus, a change in pumping current (e.g., a delta pumping current) may be determined. The delta pumping current may be averaged over the duration of the DFSO condition such that an ambient humidity may be determined.

Continuing with FIG. 4, at 410 of routine 400, the average change in pumping current is determined. Once the average change in pumping current is determined, a first indication of ambient humidity is determined based on the average change in pumping current at 412. By modulating the reference voltage and determining an average change in pumping current, the effect of a changing air fuel ratio at the beginning of a fuel shut off duration when residual combustion gases may be present in the exhaust may be nullified, for example. As such, an indication of ambient humidity may be generated relatively quickly after fuel injection is suspended, even if the exhaust gas is not free of residual combustion gases.

Referring back to 404, if it is determined that the duration since fuel shut off is greater than the threshold duration, the routine moves to 414 and the sensor is operated in a second mode in which the reference voltage is increased to a threshold voltage, but not modulated. The threshold voltage may be a voltage at which a desired molecule is dissociated. As an example, the reference voltage may be increased to 950 mV or another voltage at which water molecules may be dissociated. At 416, the change in pumping current due to the increased reference voltage is determined. At 418, a second indication of ambient humidity is determined based on the change in pumping current determined at 416. After the threshold duration, the exhaust gas may be free from residual combustion gases. As such, an indication of ambient humidity may be generated without modulating the reference voltage at a rapid rate.

As described in detail above, an exhaust gas sensor may be operated in at least two modes in which the pumping voltage or pumping current of the pumping cell is monitored. As such, the sensor may be employed to determine the absolute ambient humidity of the air surrounding the vehicle as well as the air-fuel ratio of the exhaust gas. Subsequent to detection of the ambient humidity, a plurality of engine operating parameters may be adjusted for optimal engine performance, which will be explained in detail below. These parameters include, but are not limited to, an amount of exhaust gas recirculation (EGR), spark timing, air-fuel ratio, fuel injection, and valve timing. In one embodiment, one or more of these operating parameters (e.g., EGR, spark timing, air-fuel ratio, fuel injection, valve timing, etc.) are not adjusted during the modulating of the reference voltage FIG. 6 shows a flow chart illustrating a routine 600 for adjusting engine operating parameters based on an ambient humidity generated by an exhaust gas sensor such as the ambient humidity generated as described with reference to FIG. 4, for example. Specifically, the routine determines the humidity and adjusts one or more operating parameters based on the humidity. For example, an increase in water concentration of the air surrounding the vehicle may dilute a charge mixture delivered to a combustion chamber of the engine. If one or more operating parameters are not adjusted in response to the increase in humidity, engine performance and fuel economy may decrease and emissions may increase; thus, the overall efficiency of the engine may be reduced.

At 602, engine operating conditions are determined. The engine operating conditions may include EGR, spark timing, and air fuel ratio, among others, which may be affected by fluctuations of the water concentration in ambient air.

Once the operating conditions are determined, the routine proceeds to 604 where the ambient humidity is determined. The ambient humidity may be determined based on an exhaust gas sensor, such as the exhaust gas sensor described above with reference to FIG. 2. For example, the ambient humidity may be determined based on 412 or 418 of routine 400 described with reference to FIG. 4.

Once the ambient humidity is determined, the routine continues to 606 where one or more operating parameters are adjusted based on the ambient humidity. Such operating parameters may include an amount of EGR, spark timing, and air-fuel ratio, among others. As described above, in internal combustion engines, it is desirable to schedule engine operating parameters, such as spark timing, in order to optimize engine performance. In some embodiments, only one parameter may be adjusted responsive to the humidity. In other embodiments, any combination or subcombination of these operating parameters may be adjusted in response to measured fluctuations in ambient humidity.

In one example embodiment, an amount of EGR may be adjusted based on the measured ambient humidity. For example, in one condition, the water concentration in the air surrounding the vehicle may have increased due to a weather condition such as fog; thus, a higher humidity is detected by the exhaust gas sensor during engine non-fueling conditions. In response to the increased humidity measurement, during subsequent engine fueling operation, the EGR flow into at least one combustion chamber may be reduced. As a result, engine efficiency may be maintained.

Responsive to a fluctuation in absolute ambient humidity, EGR flow may be increased or decreased in at least one combustion chamber. As such, the EGR flow may be increased or decreased in only one combustion chamber, in some combustion chambers, or in all combustion chambers. Furthermore, the magnitude of change of the EGR flow may be the same for all cylinders or the magnitude of change of the EGR flow may vary by cylinder based on the specific operating conditions of each cylinder.

In another embodiment, spark timing may be adjusted responsive to the ambient humidity. In at least one condition, for example, spark timing may be advanced in one or more cylinders during subsequent engine fueling operation responsive to a higher humidity reading. Spark timing may be scheduled so as to reduce knock in low humidity conditions (e.g., retarded from a peak torque timing), for example. When an increase in humidity is detected by the exhaust gas sensor, spark timing may be advanced in order to maintain engine performance and operate closer to or at a peak torque spark timing.

Additionally, spark timing may be retarded in response to a decrease in ambient humidity. For example, a decrease in ambient humidity from a higher humidity may cause knock. If the decrease in humidity is detected by the exhaust gas sensor during non-fueling conditions, such as DFSO, spark timing may be retarded during subsequent engine fueling operation and knock may be reduced.

It should be noted that spark may be advanced or retarded in one or more cylinders during subsequent engine fueling operation. Further, the magnitude of change of spark timing may be the same for all cylinders or one or more cylinders may have varying magnitudes of spark advance or retard.

In still another example embodiment, exhaust gas air fuel ratio may be adjusted responsive to the measured ambient humidity during subsequent engine fueling operation. For example, an engine may be operating with a lean air fuel ratio optimized for low humidity. In the event of an increase in humidity, the mixture may become diluted, resulting in engine misfire. If the increase in humidity is detected by the exhaust gas sensor during non-fueling conditions, however, the air fuel ration may be adjusted so that the engine will operate with a less lean, lean air fuel ratio during subsequent fueling operation. Likewise, an air fuel ratio may be adjusted to be a more lean, lean air fuel ratio during subsequent engine fueling operation in response to a measured decrease in ambient humidity. In this way, conditions such as engine misfire due to humidity fluctuations may be reduced.

In some examples, an engine may be operating with a stoichiometric air fuel ratio or a rich air fuel ratio. As such, the air fuel ratio may be independent of ambient humidity and measured fluctuations in humidity may not result in an adjustment of air fuel ratio.

In this way, engine operating parameters may be adjusted responsive to an ambient humidity generated by an exhaust gas sensor coupled to an engine exhaust system. As DFSO may occur numerous times during a drive cycle, an ambient humidity measurement may be generated several times throughout the drive cycle and one or more engine operating parameters may be adjusted accordingly, resulting in an optimized overall engine performance despite fluctuations in ambient humidity. Furthermore, the engine operating parameters may be adjusted responsive to the ambient humidity regardless of a duration the engine non-fueling conditions, as an indication of ambient humidity may be generated in a short amount of time even if the exhaust gas is not devoid of residual combustion gases by modulating the reference voltage.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

Such claims, whether broader, narrower, equal, or different in scope to the original claims, also are regarded as included within the subject matter of the present disclosure.

The invention claimed is:

1. A method for an engine system, comprising:

during engine non-fueling conditions, where at least one intake valve and one exhaust valve are operating:

modulating a reference voltage of an exhaust gas sensor;

generating an indication of ambient humidity by averaging a change in pumping current for each modulation between a first voltage and a second voltage; and during subsequent engine fueling conditions, adjusting an engine actuator based on the indication of ambient humidity.

2. The method of claim 1, wherein the sensor is an exhaust gas oxygen sensor.

3. The method of claim 1, wherein the engine non-fueling conditions include deceleration fuel shut off.

4. The method of claim 1, wherein the ambient humidity is an absolute humidity.

5. The method of claim 1, further comprising, after a threshold duration of the non-fueling conditions, generating a second indication of ambient humidity based on the sensor without modulating the reference voltage.

6. The method of claim 1, wherein the engine actuator adjusts an engine combustion air fuel ratio, and adjusting the air fuel ratio includes maintaining a desired exhaust air fuel ratio based on the sensor.

7. The method of claim 1, wherein the engine actuator adjusts an amount of exhaust gas recirculation, and, in at least one condition, adjusting the amount of exhaust gas recirculation includes reducing the amount of exhaust gas recirculation responsive to an indication of higher humidity.

8. The method of claim 1, wherein modulating the reference voltage includes switching the reference voltage between the first voltage and the second voltage.

9. The method of claim 8, wherein the first voltage is 450 mV and the second voltage is 950 mV.

10. A method for an exhaust gas sensor coupled in an exhaust passage of an engine, comprising:

during engine non-fueling conditions, where at least one intake valve and one exhaust valve are operating:

modulating a reference voltage between a first voltage and a second voltage;

generating a change in pumping current for each modulation;

averaging the change in pumping current throughout the non-fueling conditions; and generating a first indication of ambient humidity based on the average of the change in pumping current;

after a threshold duration, generating a second indication of ambient humidity based on the sensor by increasing the reference voltage to a threshold voltage; and during subsequent engine fueling conditions, adjusting an engine actuator based on the ambient humidity.

11. The method of claim 10, wherein the first voltage is 450 mV and the second voltage is 950 mV.

12. The method of claim 10, wherein the threshold voltage is a voltage at which water molecules are dissociated.

13. The method of claim 10, wherein the sensor is an exhaust gas oxygen sensor, and wherein the non-fueling conditions include deceleration fuel shut off.

14. The method of claim 10, wherein the engine actuator adjusts one or more of an amount of exhaust gas recirculation, spark timing, and engine air fuel ratio.

15. The method of claim 14, wherein adjusting the amount of exhaust gas recirculation includes increasing the amount of exhaust gas recirculation responsive to an indication of lower humidity.

16. The method of claim 14, wherein adjusting the spark timing includes advancing the spark timing responsive to an indication of higher humidity.

17. The method of claim 14, wherein adjusting the engine air fuel ratio includes increasing a lean air fuel ratio responsive to an indication of higher humidity.

18. A system, comprising:

an engine with an exhaust system;

an exhaust gas oxygen sensor disposed in the exhaust system;

a control system in communication with the sensor, the control system including non-transitory instructions to: during an engine non-fueling condition and before a threshold duration, modulate a reference voltage of the sensor between a first voltage and a second voltage, and generate a first indication of ambient humidity based on a change in pumping current responsive to the modulation of the reference voltage; during the engine non-fueling condition and after a threshold duration, increase the reference voltage to the second voltage, and generate a second indication of ambient humidity based on a change in pumping current responsive to the change in reference voltage; and, during subsequent engine fueling conditions, adjust one or more engine operating parameters based on the ambient humidity.

19. The system of claim 18, wherein the engine operating parameters include amount of exhaust gas recirculation, engine air fuel ratio, and spark timing.

* * * * *